United States Patent [19]

Ishihara et al.

[11] Patent Number: 4,702,934

[45] Date of Patent: Oct. 27, 1987

[54] ELECTROPHOTOGRAPHIC PHOTOSENSITIVE MEMBER, PROCESS AND APPARATUS FOR THE PREPARATION THEREOF

[75] Inventors: Shunichi Ishihara, Ebina; Keishi Saito, Nabari; Shunri Oda, Tokyo; Isamu Shimizu, Yokohama, all of Japan

[73] Assignee: Canon kabushiki Kaisha, Tokyo, Japan

[21] Appl. No.: 843,277

[22] Filed: Mar. 24, 1986

[30] Foreign Application Priority Data

Mar. 28, 1985 [JP] Japan ..... 60-064248

[51] Int. Cl.[4] ..... B05D 3/06

[52] U.S. Cl. ..... 427/39; 118/50.1; 118/719; 118/730; 427/45.1

[58] Field of Search ..... 427/38, 39, 86, 45.1; 118/719, 723, 730, 50.1

[56] References Cited

U.S. PATENT DOCUMENTS

| | | | |
|---|---|---|---|
| 4,282,267 | 8/1981 | Kuyel | 427/38 |
| 4,430,185 | 2/1984 | Shimomoto et al. | 427/39 |
| 4,439,463 | 3/1984 | Miller | 427/39 |
| 4,521,447 | 6/1985 | Ovshinsky et al. | 427/39 |
| 4,526,805 | 7/1985 | Yoshizawa | 427/39 |
| 4,532,199 | 7/1985 | Ueno et al. | 427/39 |
| 4,543,267 | 9/1985 | Yamazaki | 427/86 |
| 4,563,367 | 1/1986 | Sherman | 427/39 |
| 4,564,997 | 1/1986 | Matsuo et al. | 427/38 |

FOREIGN PATENT DOCUMENTS

| | | | |
|---|---|---|---|
| 074212 | 3/1983 | European Pat. Off. | 118/719 |
| 57-66625 | 4/1982 | Japan . | |
| 199035 | 11/1984 | Japan | 427/39 |

OTHER PUBLICATIONS

Brodsky et al., *IBM Tech. Disc. Bull.* V22, No. 8A, Jan. 1980, pp. 3391, 3392.

*Primary Examiner*—John H. Newsome

*Attorney, Agent, or Firm*—Fitzpatrick, Cella, Harper & Scinto

[57] ABSTRACT

A process and an apparatus for preparing an electrophotographic photosensitive member with the use of an active species and a precursor in the absence of a plasma.

18 Claims, 6 Drawing Figures

ELECTROPHOTOGRAPHIC PHOTOSENSITIVE MEMBER, PROCESS AND APPARATUS FOR THE PREPARATION THEREOF

FIELD OF THE INVENTION

This invention relates to an electrophotographic photosensitive member and to a process and an apparatus for preparing the same.

BACKGROUND OF THE INVENTION

There have been proposed a number of amorphous silicon films usable as a light accepting layer for electrophotographic photosensitive members.

Along with those amorphous silicon films, there have been proposed various methods for their preparation by means of vacuum evaporation, thermal indiced chemical vapor deposition, plasma chemical vapor deposition technique, reactive sputtering, ion plating and light induced chemical vapor deposition.

Among those methods, the method of thermal induced chemical vapor deposition (hereinafter referred to as "CVD method") had been frequently used in various sectors, but nowadays it is usually not employed because elevated temperature is required and a practically usable deposited film can not be obtained as expected.

On the other hand, the method of plasma chemical vapor deposition (hereinafter referred to as "plasma CVD method") has been generally accepted as being the most preferred and is currently used in industry to manufacture an amorphous silicon film on a commercial basis.

However, for any of the known amorphous silicon films, even if it is obtained by the plasma CVD method, there still remain unsolved problems not only regarding its characteristics, particularly electric and optical characteristics, deterioration resistance and use-environmental characteristics upon repeated use, which are to be adapted to its use as a light accepting layer for electrophotographic photosensitive member, but also for other points such as its homogeneity, reproductibility and mass-productivity.

Now, although the plasma CVD method is widely used nowadays as above mentioned, it is still associated with problems due to the fact that it is practiced under elevated temperature conditions and other problems arise in the process, including the apparatus to be used.

Regarding the former problems, because the plasma CVD method is practiced while maintaining a substrate at elevated temperature, firstly the kind of the substrate to be used is limited to one that does not contain a material such as a heavy metal which migrates and sometimes causes changes in the characteristics of a deposited film to be formed and secondly its thickness is likely to be varied on standing whereby the resulting deposited film lacks uniformity in thickness and in homogeneity of the composition which also can sometimes cause changes in the characteristics of the deposited film.

Regarding the latter problems, for the process, the operation conditions to be employed under the plasma CVD method are much more complicated than the known CVD method, and are extremely difficult to be generalized.

That is, there already exist a number of variations even in the corelated parameters concerning the temperature of a substrate, the amount and the flow rate of gases to be introduced, the pressure degree and the high frequency power for forming a layer, the structure of an electrode, the structure of a reaction chamber, the exhaust rate and the plasma generation system, and besides these parameters, there also exist other kinds of parameters. Under these circumstances, in order to obtain a desirable deposited film product, it is required to choose precise parameters from a great number of varied parameters. And there sometimes occurs a serious problem that because of the precisely chosen parameters, a plasma is apt to be in an unstable state which often imparts unexpected troublesome effects to a deposited film to be formed.

As for the apparatus in which the process using the plasma CVD method is practiced, its structure will eventually become complicated because the parameters to be employed are precisely chosen as above stated, and whenever the scale or the kind of the apparatus to be used is modified or changed, the apparatus must be so structured as to cope with the precisely chosen parameters.

In this regard, even if a desirable deposited film usable as a photoconductive layer for electrophotographic photosensitive member should be fortuitously produced, the film product unavoidably becomes costly for the reasons that a heavy investment is firstly necessitated to set up a particularly appropriate apparatus therefor, there still exist a number of process operation parameters even for such apparatus, the relevant parameters are to be precisely chosen from the existing various parameters for the production of such film, and in accordance with such precisely chosen parameters, the process is to be carefully practiced.

Against this background, there is now an increased demand for provision of such a method that makes it possible to practice the process at lower temperature and at a high film forming rate in a simple apparatus to produce a desirable light accepting layer for an electrophotographic photosensitive member which has good uniformity and has practically applicable characteristics, whereby the product will be low-priced.

Likewise, there is a similar situation with respect to other kinds of light accepting layers for electrophotographic photosensitive member such as nitrided silicon film, carbided silicon film and oxidized silicon film.

SUMMARY OF THE INVENTION

The present inventors have conducted extensive studies in order to solve the problems in the aforementioned known methods and in order to develop a new process for effectively and simply preparing a desirable deposited film usable as a light accepting layer for electrophotographic photosensitive member, for instance, an amorphous silicon which has practically applicable characteristics.

As a result, the present inventors finally have found a method that enables one to efficiently and stably form said film in simplified procedures as detailed below.

It is therefore an object of this invention to provide a desirable electrophotographic photosensitive member having a deposited film as its light accepting layer having practically applicable characteristics, which is prepared by chemically and mutually reacting a precursor contributing to form said layer and an active species being reactive with said precursor without plasma discharge.

Another object of this invention is to provide a new process for producing the above film using a precursor contributing to form the above film and an active species which can be chemically and mutually reacted with the precursor at lower temperatures and without the presence of a plasma to form the above film on a substrate in a film formation space of a closed system at a high film forming rate.

A further object of this invention is to provide an apparatus suitable for practicing said new process.

According to one aspect, this invention aims at accomplishing simplification of the film forming conditions for the preparation of a functional deposited film as a light accepting layer of an electrophotographic photosensitive member so as to enable mass-production of an electrophotographic photosensitive member while maintaining the characteristics of the film to be formed and promoting the film forming rate at lower temperature in a film forming space without using a plasma reaction.

According to a further aspect of this invention, there is provided an electrophotographic photosensitive member having a functional deposited film as its light accepting layer which is prepared by introducing a precursor contributing to form the film and an active species being chemically and mutually reactive with the precursor into a film forming space, the active species being passed through a transportation space leading to the film forming space and the precursor being passed through the other transportation space leading to the film forming space which is provided within the foregoing transportation space, and chemically and mutually reacting the two substances at lower temperature in the film forming space.

According to a further aspect of this invention, there is provided a process for producing an electrophotographic photosensitive member having a functional deposited film as its light accepting layer, characterized in that a precursor contributing to form the film and an active species being chemically and mutually reactive with the precursor are together used, the active species is passed through a transportation space of which the downstream side leads to a film forming space, the precursor is passed through the other transportation space leading to the film forming space which is provided within the foregoing transportation space, and the two substances thus introduced are chemically and mutually reacted to form the film on a substrate placed in the film forming space without elevating the temperature of the substrate and in the absence of a plasma.

According to a further aspect of this invention, there is provided an apparatus suitable for practicing the above process, characterized in that an active species generation chamber, an active species transportation passage being situated at the downstream side of the active species generation chamber, a precursor generation chamber, a precursor transportation passage being situated separately from and within the active species transportation passage and a film formation chamber having a substrate supporting means therein are provided.

According to this invention, since a precursor contributing to form a deposited film and an active species being chemically and mutually reactive with the precursor even at lower temperature are used, there is no particular limitation on the kind of a substrate to be used as in the known plasma CVD method, and the formation of a deposited film on a substrate may be effectively carried out at a high film forming rate without elevating the temperature of the substrate, namely at 80 to 120 C. lower temperature than that in the known plasma CVD method, and in the absence of a plasma to obtain a desirable deposited film being well fixed to the substrate.

In addition, according to this invention, the control of the film forming conditions is facilitated and the quality control of the film to be prepared can be easily implemented since the film forming space for preparing a desirable functional deposited film is situated separately from the space for generating a precursor and from the space for generating an active species, the former space and the latter space being different from one another and plasma discharge is not utilized.

In this invention, an active species and a precursor are introduced into a film forming space respectively through an active species transportation space and a precursor transportation space. It is possible to optionally determine the residence time for the precursor within the precursor transportation space by appropriately changing the location of its open portion within the active species transportation space, wherein the transportation rate of the precursor in the precursor transportation space may be chosen as one of the variable parameters to control the residence time.

The position opening to the film forming space of the precursor transportation space and that of the active species transportation space may be determined with due regard to the life span of the active species and to the life span of the precursor.

As for the position which opens to the film forming space of the active species transportation space, it is preferred to be as close as possible to the film forming region since there are generally used a precursor of a relatively long life span and an active species of a rather shorter life span.

The open portion of the active species transportation space to the film forming space and the open portion of the precursor transportation space to the film forming space are preferred to be respectively in the form of either a nozzle or an orifice.

And, particularly when both the open portions are in the form of a nozzle, film formation efficiency and feed consumptive effectiveness may be remarkably improved by situating the nozzle openings at a closer position to the film forming surface of the substrate in the film forming space.

In general, the active species is generated in a species activation space being connected to the active species transportation space at its upstream portion, and the precursor is generated in a precursor generation space being connected to the precursor transportation space at its upstream portion.

However, as an alternative, both the active species transportation space and the precursor transportation space may be so constructed as to double respectively as the active species generation space and the precursor generation space.

In that case, the active species generation means and the precursor generation means need not always be separately provided. The related system may be so structured that a sole means serves as both the active species generation means and the precursor generation means. As an example in this respect, there can be illustrated a double conduit such as a double glass pipe which is structured to have an inner passage as the active species transportation space and an outer passage as the precursor transportation space. In this case, there is placed a microwave power source around the circumference of the double conduit so as to generate an active species and a precursor flowing in the direction of a gas current at the same time. The open portion of each of the active species transportation space and the precursor transportation space is preferred to be situated within the film forming space.

The number of double space structural conduits having the precursor transportation space being horizontally situated within the active species transportation space, which is connected to a film forming space, is not limited to be one but may be plural.

In the latter case, a deposited film constituted by the plural number of constitutive layers, each of which having a different characteristic, may be formed on a substrate placed within the film forming space by changing the kind of the active species and/or the kind of the precursor to be introduced through each of the double space structural conduits.

In that case, it is possible to simultaneously start forming each of the layers on a respective position of the substrate. And it is also possible to form such a multilayered film as having various layers, for example, (A) to (N) layers by firstly forming the (A) layer, then the (B) layer, . . . and finally the (N) layer.

As a more detailed example, when a light accepting layer of electrophotographic photosensitive member having a barrier layer capable of preventing injection of electric carriers from the side of a substrate upon charging for producing electrostatic image, a photoconductive layer and a surface layer in that order from the side of the substrate is formed on the substrate to obtain an electrophotographic photosensitive member, it may be prepared by using three said double space structural conduits in the following way. That is, the barrier layer is formed on the substrate by using the first conduit, the photoconductive layer is then formed on the barrier layer already formed on the substrate by using the second conduit and finally the remaining surface layer is formed on the photoconductive layer by using the third conduit.

In this case, the formation of each of the three layers on the substrate may be carried out in the same film forming space by starting the formation of a successive layer after the formation of the former layer has been completed. And in another alternative, the formation of each of the three layers may be carried out in concurrent progression simply by letting the starting time for the formation of each layer be delayed for a predetermined time period, although there is somewhat of a local delay in the formation of each layer.

In this invention, it is a matter of course that the formation of each layer in the above case may be carried out in a different film forming space.

However, the process in the above case that makes the most of the characteristic points of this invention is that of multiple layers, each of which having a different characteristic, are formed on a substrate in concurrent progression in the same film forming space.

Further, according to this invention, there are provided the advantages that notwithstanding the formation of a deposited film on a substrate is carried out without elevating the temperature of the substrate and in the absence of plasma, this being distinguished from the case of the known plasma CVD method, a desirable deposited film having a uniform thickness and a desirable homogeneity may be effectively formed at an improved film forming rate without a deposited film being removed from the substrate. This is often found in the known plasma CVD method when it is practiced while the substrate being maintained at lower temperature, the deposited film to be formed on the substrate is affected neither by any of the undesirable materials removed from the inner surface of the surrounding wall of the film forming space and nor by the residual gases remaining in the film forming space due to that the film forming space, the active species generation space and the precursor generation space being individually situated.

The term "precursor" in this invention means such a substance which can be a constituent of a deposited film but can not or scarcely contribute to form said deposited film as long as it is in an unexcited energy state.

On the other hand, the "active species" of this invention is a substance which causes a chemical and mutual reaction with the precursor to impart an energy to the precursor thereby to cause the precursor to be in an activated state capable of contributing to form the deposited film.

Therefore, as for the active species to be used, it may be either a substance which contains one or more elements to be one or more constituents for a deposited film to be formed or another kind of substance which does not contain such elements.

The precursor which is introduced into the film forming space through the precursor transportation space will become a principal constituent of a deposited film to be formed on a substrate in the film forming space. The longer the life span of the precursor to be used, the better.

As the precursor, a substance of average life span preferably more than 0.01 second, more preferably more than 0.1 second, and furthermore most preferably more than 1.0 second is selectively used.

The active species to be introduced into the film forming space through the active species transportation space should be such a substance whose average life span is preferably less than 10 seconds, more preferably less than 8.0 seconds and furthermore most preferably less than 5.0 seconds.

At the time when a deposited film is formed on a substrate in the film forming space, the active species chemically and mutually reacts with a precursor containing one or more elements to be principal constituents of a deposited film to be formed, the precursor being introduced into the film forming space at the same time when the active species is introduced thereinto through the active species transportation space, whereby the desired deposited film is easily and effectively formed on a desired substrate.

According to this invention, because the deposited film may be formed without any generation of a plasma in the film forming space, there is no occasion that a deposited film to be formed be subjected to the influence of an etching action or other actions due to unexpectedly occurring abnormal discharge and the like, as found in the known plasma CVD method.

The process for preparing a deposited film according to this invention is a modification of the known CVD method, and to be distinguished from the known CVD method, it will be appropriate for it to be categorized as "New CVD method".

One remarkable point among others by which the "New CVD method" of this invention is clearly distinguished from the known CVD method is that there is used an active species which has been generated in a space separately situated from the film forming space.

Because of this, such invention brings about various significant advantages such that in comparison with the known plasma CVD method, the film forming rate is greatly improved and at the same time, a deposited film superior in quality and in stable characteristics may be obtained. In addition, the temperature of a substrate is lower than in the case of the known plasma CVD method when a deposited film is formed thereon, and a deposited film possessing excellent characteristics may be mass-produced on an industrial scale thereby allowing the product to be low-priced.

The active species to be used in this invention is generated in the active species generation space by activating a relevant stock to generate the active species, for example, by subjecting it to the action of an exciting energy of an electric discharge, light or heat or by reacting or contacting it with a relevant catalyst or by adding the catalyst thereto.

Usable as the stock are, for example, $H_2$, $SiH_4$, $SiH_3F$, $SiH_3Cl$, $SiH_3Br$, $SiH_3I$, etc., and other than these, rare gases such as He, Ne, Ar, etc. are also usable.

A suitable compound is used for the generation of the precursor to be used in this invention.

As such a compound, there is usually used a silicon containing compound in which an electron highly absorptive atom or atomic group or a polar radical is bonded to the silicon atom.

Said silicon containing compound is subjected to the action of an exciting energy of an electric discharge, light or heat to generate the precursor in the precursor generation space.

Usable as the silicon containing compound are, for example, $Si_nX_{2n+2}$ (n=1, 2, 3—, *X—F, Cl, Br, I*), $(SiX_2)_n$ ($n \geqq 3$, X=F, Cl, Br, I), $Si_nX_{2n+1}$ (n=1, 2, 3—, X=F, Cl, Br, I), $Si_nH_2X_{2n}$ (n=1, 2, 3—, X=F, Cl, Br, I), etc.

Specific examples are $SiF_4$, $(SiF_2)_5$, $(SiF_2)_6$, $(SiF_2)_4$, $Si_2F_6$, $SiHF_3$, $SiH_2F_2$, $SiCl_4$, $(SiCl_2)_5$, $SiBr_4$, $(SiBr_2)_5$, etc. which are in the gaseous state or can be easily made to be in the gaseous state.

Other than these compounds, $SiH_2(C_6H_5)_2$, $SiH_2(CN)_2$, etc. may be also used in accordance with the intended use of a deposited film to be formed.

In a preferred embodiment of this invention, the precursor and the active species are well mixed in advance before being introduced into the film forming space and then the mixture is introduced into the film forming space. Soon after the mixture is introduced into the film forming space, if necessary, it is possible to apply an energy of light or heat to the inner atmosphere of the film forming space where the film forming process is to be conducted or to the substrate placed in the film forming space on which a deposited film is to be formed, thereby to further promote the film forming rate and to further effectively and efficiently accomplish film formation.

The volume ratio of the precursor to the active species to be mixed may be determined appropriately with due regard to the film forming conditions, the kind of precursor to be used and the kind of active species to be used etc., but it is preferably 100:1 to 1:100, and more preferably, 10:1 to 1:10 on the basis of a flow amount ratio.

The position for the precursor transportation space opening in the active species transportation space is situated at the position preferably 0.1 mm to 200 mm, and more preferably 1.0 mm to 100 mm distant from the position of the active species transportation space opening into the film forming space.

DESCRIPTION OF THE PREFERRED EMBODIMENT

Figure 1:
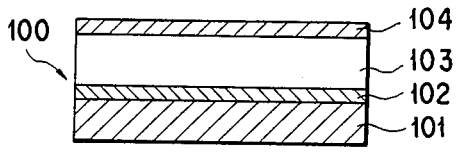
FIG. 1 is a schematic cross sectional view of an embodiment of an electrophotographic photosensitive member according to this invention.

FIG. 1 shows a representative structure of the electrophotographic photosensitive members according to this invention.

Referring to FIG. 1, electrophotographic photosensitive member 100 has a structure composed of photoconductive layer 103, intermediate layer 102 in the case where necessary, and surface layer 104 on substrate 101 suitable for electrophotography.

Substrate 101 may be electroconductive or electrically insulating.

Usable as the electroconductive substrate are, for example, metals such as Al, Cr, Mo, Au, Ir, Nb, Ta, V, Ti, Pt, Pd and the like, or alloys such as NiCr, stainless steel or alloys of said metals.

Usable as the electrically insulating substrate are, for example, films or sheets of synthetic resin such as polyester, polyethylene, polycarbonate, cellulose acetate, polypropylene, polyvinyl chloride, polyvinylidene chloride, polystyrene, polyamide and the like, and other than these, glass or ceramics. For the electrically insulating substrate, it is desirable that at least one surface thereof is conductivized and a desired layer is formed on the conductivized surface of the substrate.

For example, in the case of glass, its surface may be conductivized by depositing a thin layer of a metal or an oxide such as NiCr, Al, Cr, Mo, Au, Ir, Nb, Ta, V, Ti, Pt, Pd, $In_2O_3$, $SnO_2$, ITO ($In_2O_3+SnO_2$) etc. In the case of synthetic resin film such as polyester film etc., its surface may be conductivized with a metal such as NiCr, Al, Ag, Pd, Zn, Ni, Au, Cr, Mo, Ir, Nb, Ta, V, Ti, Pt, etc. in accordance with vacuum vapor deposition, electron beam vapor deposition or sputtering. Alternatively, its surface may be also conductivized by laminating it with one of said metals.

The shape of the substrate may be optionally determined. Examples of the useable shape are drum, belt, plate and the like. In the case of a continuous high speed copying machine, the shape of the substrate is preferred to be in the form of an endless belt or drum.

The thickness of the substrate is optional. For example, when a flexible electrographic photosensitive member is desired, the thickness of a substrate to be used is preferred to be as thin as possible. But it is usually not less than 10 microns from the view points of its manufacturing and handling conveniences and its strength.

The intermediate layer 102, which is composed of a nonelectroconductive amorphous material containing, for example, silicon atom and carbon atom or hydrogen atom or halogen atom (X), has the function of effectively preventing carriers coming from the side of the substrate 101 from being injected into the photoconductive layer 103 and of facilitating the passage of photocarriers into the side of the substrate 101, which are generated in the photoconductive layer 103 when an electromagnetic wave is irradiated and moves toward the side of the substrate 101.

In case of forming the intermediate layer 102, the related process may be so carried out that following the formation of the intermediate layer, the photoconductive layer may successively formed.

In that case, a gas for forming the intermediate layer may be mixed with a rare gas such as He or Ar in a predetermined mixing ratio on the basis of volumetric weight.

In this invention, the formation of the intermediate layer 102 may be carried out, for example, in the following way.

Firstly an active species generative stock gas is introduced into an activation space to which a desired activation energy is applied thereby forming an atmosphere containing active species generated therein, which is then passed through an active species transportation space.

In parallel, a precursor generative gas is introduced into a precursor generation space to which a desired activation energy is applied thereby to generate a precursor, which is then passed through a precursor transportation space being situated within the active species transportation space.

The gas containing active species and the gas containing precursors are mixed in a mixing space situated in the active species transportation space wherein the two substances will start chemically and mutually reacting, and the resulting gas mixture is successively introduced into a film forming space, where the substrate 101 is placed, whereby the intermediate layer 102 is formed on the substrate 101. In this case, if necessary, a desired energy may be applied in order to further promote the film forming rate.

Usable as the active species generative stock are, for example, silane compounds being abundant in hydrogen atoms, which are in gaseous state or can be easily made in a gaseous state, such as $SiH_4$, $SiH_3Cl$, $SiH_3F$, $SiH_3Br$ and the like nitrogen ($N_2$) or nitrogen compounds being composed of nitrogen atom (N) and hydrogen atom (H), which are in gaseous state or can be easily made to be in the gaseous state, such as nitrides and azides represented by $NH_3$, $H_2NNH_2$, $HN_3$, $NH_4N_3$ and the like, and other than these, saturated hydrocarbons having 1 to 5 carbon atoms, ethylenic hydrocarbons having 2 to 5 carbon atoms and acetylenic hydrocarbons having 2 to 4 carbon atoms.

As the saturated hydrocarbon, there may be illustrated $CH_4$ $C_2H_4$, $C_3H_8$, n—$C_4H_{10}$ and $C_5H_{12}$. As the ethylenic hydrocarbon, there may be illustrated $C_2H_2$, $C_3H_4$ and $C_4H_6$.

In addition to these, the following are also usable as the active species generative stock; namely, they are $O_2$, $O_3$, CO, $CO_2$, NO, $NO_2$, $N_2O$ and the like.

The active species generative stock to be used for the formation of the intermediate layer 102 is appropriately selected from the stocks as above mentioned and used so that a predetermined atom contained in the selected stock may be sufficiently incorporated into the intermediate layer 102 to be formed.

As the precursor generative substance to generate a precursor in the precursor generation space, silane compounds such as $SiF_4$, $SiH_2F_2$ and the like may be illustrated as being effective precursor generative substances, and these substances may easily generate precursors of a long average life span with the action of a desired activation energy.

The thickness of the intermediate layer 102 is preferably 30 to 1000 Å, and more preferably 50 to 600 Å.

The photoconductive layer 103 is to be so structured that it can bring about desirable photoconductive characteristics as the photoconductive layer in the image forming member for electrophotography. In consequence, the photoconductive layer 103 is preferred to be composed of amorphous silicon a-SiX(H) containing silicon atom as a main component, halogen atom (X) and if necessary hydrogen atom (H).

The formation of the photoconductive layer 103 may be carried out in the same way as in the formation of the intermediate layer 102. That is, an active species generative stock such as $SiH_4$, $SiH_3F$ or the like is introduced into an activation space to which a desired activation energy is applied thereby to generate an active species, which is successively passed through an active species transportation space. In parallel with this, a precursor generative substance such as $SiF_4$, $SiF_2H_2$ or the like is introduced into a precursor generation space to which a desired activation energy is applied thereby to generate a precursor, which is successively passed through a precursor transportation space being situated within the active species transportation space.

The gas containing active species and the gas containing precursors are mixed in a mixing space situated in the active species transportation space wherein the two substances will start chemically and mutually reacting, and the resulting gas mixture is successively introduced into a film forming space, where the substrate 101 is placed, whereby the photoconductive layer 103 is formed on the substrate 101. Also in this case, if necessary, a desired energy may be applied in order to further promote the film forming rate.

As a result, a desirable layer as the photoconductive layer 103 is prepared.

The thickness of the photoconductive layer 103 may be appropriately determined with due regard to the application object of the product to be prepared.

Now, for the photoconductive layer 103 of the electrophotographic photosensitive member 100 as shown in FIG. 1, its thickness may be determined appropriately by paying attention to the related factors in the relationship between the thickness of the intermediate layer 102 and the thickness of the photoconductive layer 103 so as to make the most of the functions of the two layers. However, in usual case, the thickness of the photoconductive layer is preferred to be some hundreds to some thousands times or more greater than that of the intermediate layer 102.

As a numerical value, it is preferably 1 to 100 μm and more preferably 2 to 50 μm. The amount of H or the total amount of H and X (X=halogen atom such as F) to be contained in the photoconductive layer of the electrophotographic photosensitive member as shown in FIG. 1 is preferably 1 to 40 atomic %, and more preferably 5 to 30 atomic %. For the amount of H alone, its lowest limit is 0.001 atomic %, and it is preferably 0.01 atomic %, and more preferably 0.1 atomic %.

The surface layer 4 in the electrophotographic photosensitive member of FIG. 1, if necessary, may be prepared in the same way as in the case of the intermediate layer 102 or the photoconductive layer 103. For example, when it is desired to form a silicon carbide layer, $SiH_4$ and $CH_4$ and $H_2$, or $SiH_4$ and $SiH_2(CH_3)_2$ are introduced in an activation space to which a relevant activation energy is applied thereby to generate an active species. In parallel with this, a precursor generative substance such as $SiF_4$ or the like is introduced into a precursor generation space to which a desired activation energy is applied thereby to generate a precursor. After this, in accordance with the procedures as above mentioned the active species and the precursor are mixed and then introduced into the film forming space while they are being chemically and mutually reacted, whereby the surface layer 104 is formed on the substrate 104.

As the surface layer 104, a deposited film having a wider band gap, such as nitrided silicon film, oxidized silicon film and the like, is preferred.

For the surface layer 104 to be compatible to the photoconductive layer 103, it is possible to form the layer by continuously changing the composition of the photoconductive layer 103.

The thickness of the surface layer 104 is preferably 0.01 to 5 μm, and more preferably 0.05 to 1.0 μm.

It is possible to make the photoconductive layer 103 to be either n-type or p-type by appropriately doping the layer with n-type impurities, p-type impurities or both the impurities while controlling its amount when the layer is being formed.

Usable as such impurities are, for example, elements of Group IIIA of the Periodic Table such as B, Al, Ga, In, Tl and the like for the p-type impurity, and elements of Group VA of the Periodic Table such as N, P, As, Sb, Bi and the like for the n-type impurity. Of these impurities, B, Ga, P and Sb are the most appropriate.

In order for the photoconductive layer 103 to have a desired type conductivity, the amount of impurity with which the photoconductive layer is doped may be determined appropriately depending upon its desired electrical and optical characteristics.

In the case of the impurities of Group IIIA of the Periodic Table, the amount will be sufficient if less than $3\times10^{-2}$ atomic %, and in the case of the impurities of Group VA of the Periodic Table, the amount will be sufficient if less than $5\times10^{-3}$ atomic %.

The process of doping the photoconductive layer 102 with these impurities may be conducted by introducing a desired dopant imparting substance in gaseous state into either the active species generation space or the precursor generation space together with a gaseous substance to generate a precursor or a gaseous stock so as to generate an active species when the layer is being formed.

As the dopant imparting substance capable of incorporating impurities into the layer, a substance in gaseous state at room temperature or another substance which can be easily made to be in the gaseous state at least under the layer forming conditions may be employed.

Usable as such substances are, for example, $PH_3$, $P_2H_4$, $PF_3$, $PF_5$, $PCl_3$, $AsH_3$, $AsF_3$, $AsF_5$, $AsCl_3$, $SbH_3$, $SbF_5$, $BiH_3$, $BF_3$, $BCl_3$, $BBr_3$, $B_2H_6$, $B_4H_{10}$, $B_5H_9$, $B_5H_{11}$, $B_6H_{10}$, $B_6H_{12}$, $AlCl_3$, etc.

PREFERRED EMBODIMENT OF THE INVENTION

The advantages of this invention are now described in more detail by reference to the following Examples, which are provided merely for illustrative purposes only, and are not intended to limit the scope of this invention.

EXAMPLE 1

In accordance with the procedures described below, an electrophotographic photosensitive member in the form of drum was prepared by using an apparatus as shown in FIG. 2.

Figure 2A:
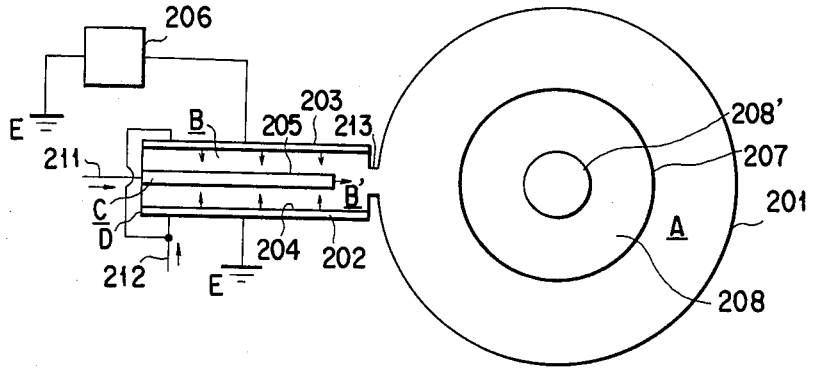
FIG. 2, FIG. 3 and FIG. 4 are schematic diagrams of apparatus suitable for practicing the process for preparing an electrophotographic photosensitive member according to this invention.
Figure 2B:
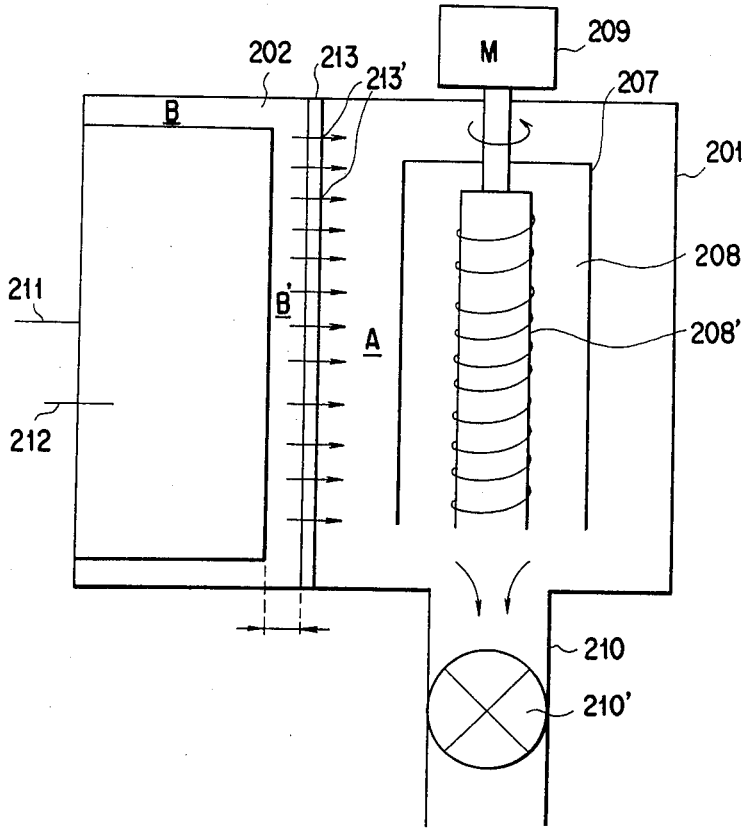

In FIGS. 2A and 2B, 201 stands for film forming chamber having film forming space A. 207 stands for substrate 207 in the form of a drum being located on substrate holder 208 having heater 208' for the substrate. 209 stands for a motor for rotating, lifting and lowering substrate holder 208 through a rotary shaft. The film forming chamber is provided with exhaust pipe 210 being connected through exhaust valve 210' to an exhaust device (not shown) and the exhaust pipe is provided with a subsidiary valve (not shown) which serves to break the vacuum in the film forming chamber 201. Letter B stands for active species transportation space doubling as an activation space to generate an active species from an active species generative stock, which has mixing region B' situated at the downstream side. The active species transportation space B is opened to film forming space A of the film forming chamber 201 through the plural number of nozzles 213', 213'—provided with party wall 213. 212 stands for a feeding pipe of an active species generative stock being connected to active species transportation space B through circumferential wall D, which has active species generative stock passage 202 formed by outer wall 203 and inner wall 204 having the plural number of gas liberation holes (not shown). 205 stands for precursor transportation conduit being opened at its end to mixing region B'. The position of the opening (not shown) of conduit 205 is situated to be about 7 cm distant from party wall 213.

Conduit 205 has inner space C to which feeding pipe 211 of a precursor generative substance is connected. 206 stands for a microwave power source being electrically connected to outer wall 203.

As substrate 207, an aluminum cylinder of 2.5 mm in thickness was used. The cylinder was cleaned in such a manner that the surface of the cylinder was treated with a 1% solution of NaOH and sufficiently washed with water to remove the solution and then dried. The cylinder thus cleaned was firmly disposed onto the surface of the substrate holder 208. The air in the inner space A of the film forming chamber and in the active species transportation space B was evacuated by opening the exhaust valve 210' to bring the inner space and the active species transportation space to a vacuum degree of about $1\times10^{-5}$ Torr. Then motor 209 was started, and at the same time the heater 208' was ignited to uniformly heat the cylinder 207 to about 300° C., the cylinder being kept at that temperature.

For the formation of a barrier layer capable of preventing injection of an electric carrier on the surface of the cylinder, a gaseous mixture of $H_2$ and $B_2H_6$ ($B_2H_6/H_2=3000$ ppm) as the active species generative stock was fed at a flow rate of 50 SCCM into the space B through the passage 202, and at the same time $SiF_4$ gas (100%) as the precursor generative substance was fed into the space C. After the flow rate of the two streams become stable, the vacuum degree of the space A was brought to and kept at about 0.002 Torr by regulating the exhaust valve 210'. The microwave power source 206 was then switched on to apply a discharge energy of 200 W into both the space B and the space C.

After an hour, there was formed a $P^+$ type barrier layer on the cylinder 207 in the film forming chamber 201. Thereafter, the microwave power source 206 was switched off, the introduction of $B_2H_6$ was terminated, and the flow rate of $H_2$ gas and that of $SiF_4$ gas were controlled respectively to be 300 SCCM.

Then, after the vacuum degree of the space B was brought to and kept at about 0.002 Torr by regulating the exhaust valve 210', the microwave power source 206 was switched on to apply a discharge energy into the space B and the space C.

After 2.5 hours, there was formed a photoconductive layer 20 μm in thickness on the barrier layer already formed on the cylinder 207.

Thereafter, the above procedures were repeated under the conditions that there were employed $H_2$ gas and $CH_4$ gas as the active species generative stock, and the flow rate of $H_2$ gas was controlled to be 100 SCCM and the flow rate of $CH_4$ was controlled to be 300 SCCM, and as the precursor generative substance there was used $SiF_4$ gas and its flow rate was controlled to be 10 SCCM. Further the vacuum degree of the space A was kept at about 0.002 Torr and a discharge energy of 200 W was applied.

After this state was maintained for 30 minutes, there was additionally formed a surface layer of about 5000 Å in thickness.

In this way, there was prepared an electrophotographic photosensitive member in drum shape of a retarding type.

When this member was examined for its electrophotographic characteristics, it was found that this member possesses sufficient practical characteristics as an electrophotographic photosensitive member.

EXAMPLE 2

Figure 3A:
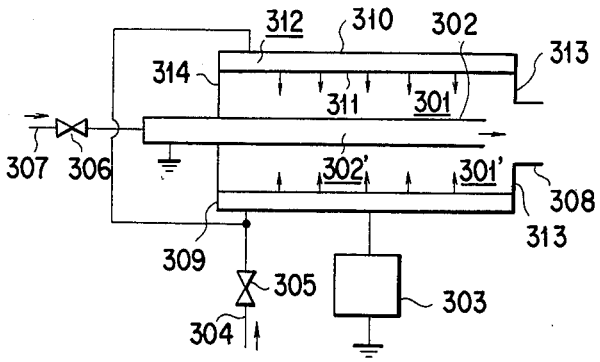
Figure 3B:
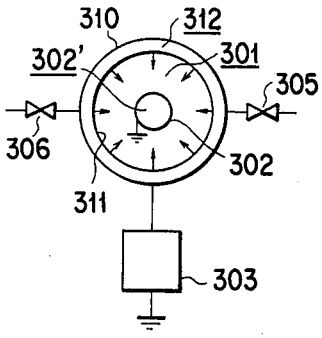
Figure 4:
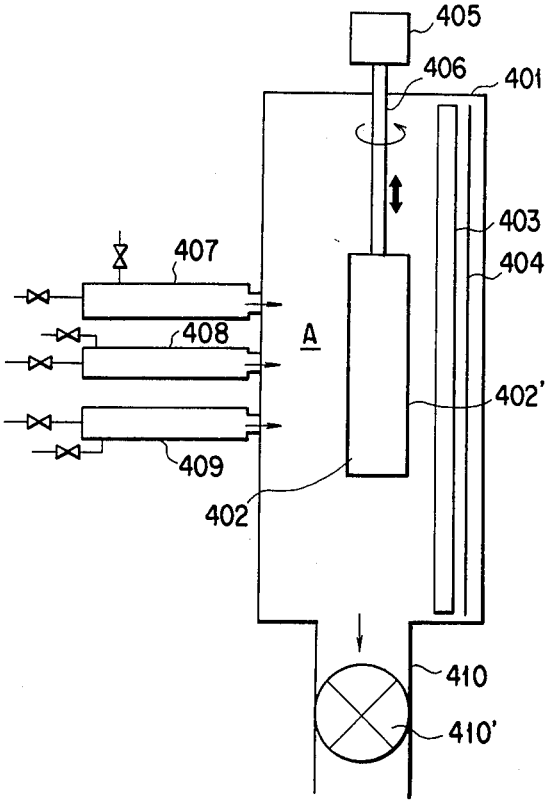

In accordance with the procedures described below, an electrophotographic photosensitive member in the form of a drum was prepared by using apparatus as shown in FIG. 3 and FIG. 4.

FIG. 3 is a detailed schematic diagram with respect to one of the activation and transportation devices 407, 408 and 409 in the apparatus shown in FIG. 4.

In FIG. 3, 301 stands for activation and transportation space having mixing region 301' at its downstream side, which is formed by circumferential wall 300 and two side walls 314 and 315. The circumferential wall 300 has active species generative stock passage 312 being formed by surrounding outer wall 310 and inner wall 311 having a plural number of gas liberation holes (not shown). 304 stands for a feeding pipe for an active species generative stock having flow rate controlling valve 305, and the feeding pipe 304 is connected to the passage 302. 302 stands for conduit having space 313' doubling as a transportation space for a precursor generative substance and precursor generation space which is situated horizontally within the space 301. 307 stands for feeding pipe for the precursor generative substance being provided with flow rate controlling valve 306, which is connected to the space 302'. 303 stands for microwave power source being electrically connected to the outer wall 310. 308 stands for a narrowed passage for gas flow, which is represented, for example, by a nozzle, to film forming space A of film forming chamber 401 of the apparatus as shown in FIG. 4.

In FIG. 4, 407, 408 and 409 stand for the activation and transportation devices as shown in FIG. 3 respectively. 402' stands for a substrate in the form of drum being placed on substrate holder 402.

405 stands for a motor for rotating, lifting and lowering the substrate holder 402 through rotary shaft 406. 403 stands for infrared lamp for heating the substrate 402'.

404 stands for a reflecting mirror for reflecting infrared radiation toward the substrate 402'. The film forming chamber is provided with exhaust pipe 410 being connected through exhaust valve 410' to an exhaust device (not shown), and the exhaust pipe 410 is provided with a subsidiary valve (not shown) which serves to break the vacuum in the film forming chamber 401.

In this example, the activation and transportation devices 407, 408 and 409 are used respectively for the formation of a $P^+$ type layer which acts as a barrier layer, the formation of a photoconductive layer and the formation of a surface layer.

An aluminum cylinder having a thickness of 2.5 mm was used as the substrate in the form of drum 402.

After the cylinder was cleaned in accordance with the procedure mentioned in Example 1, it was firmly disposed onto the surface of the substrate holder 402, and the position of the substrate holder 402 was lowered to the level where the top of the cylinder 402' was situated under the opening of the activation and transportation device 409 by the action of the rotary shaft 406. The air in the film forming chamber 401 and the activation and transportation devices 407, 408 and 409 was exhausted by opening the exhaust valve 410' to bring their spaces to a vacuum degree of about $1\times10^{-5}$ Torr. Then, the infrared lamp was switched on to uniformly heat the cylinder to about 290° C., and the cylinder was maintained at that temperature. Each of the gases as shown in Table 1 were passed into the corresponding device of the activation and transportation devices 407, 408 and 409 in accordance with the corresponding conditions as shown in Table 1, and the vacuum degree of the film forming space A was brought to and kept at about 0.002 Torr by regulating the exhaust valve 410'. Thereafter, the microwave power source was switched on to apply a discharge energy of the corresponding electric power as shown in Table 1 to each of the activation and transportation devices 407, 408 and 409 respectively.

After the microwave discharge state in each of the activation and transporation devices became stable, the cylinder was lifted with a speed of 2.4 mm/minute by the action of the rotary shaft 406. In this way, there was formed firstly a barrier layer about 3 μm, thick secondly a photoconductive layer about 20 μm thick and finally a surface layer about 0.5 μm thick thereby to prepare an electrophotographic photosensitive member in drum shape.

When this member was evaluated for its electrophotographic characteristics, it was found that this member possesses sufficient practical characteristics as an electrophotographic photosensitive member.

TABLE 1

| | Active species generative stock | Precursor generative substance | Microwave electric power | Film forming rate |
|---|---|---|---|---|
| Device 407 | $H_2$: 100 SCCM<br>$CH_4$: 300 SCCM | $SiF_4$: 20 SCCM | 60 W | 0.6Å/sec. |
| Device 408 | $H_2$: 300 SCCM | $SIF_4$: 300 SCCM | 300 W | 20Å/sec. |

TABLE 1-continued

| | Active species generative stock | Precursor generative substance | Microwave electric power | Film forming rate |
|---|---|---|---|---|
| Device 409 | $H_2$: 100 SCCM<br>$B_2H_6$ (1500 ppm added) | $SiF_4$: 300 SCCM | 40 W | 3Å/sec. |

EXAMPLE 3

The procedures as mentioned in Example 1 wherein the position of the opening of the conduit 213 in the space B was varied as shown in Table 2 were repeated to obtain deposited films on substrates in the form of drums, and the deposited films were evaluated for their applicability as a photoconductive layer for electrophotography.

Further, the deposited films were formed by conducting the deposition for an hour under the following conditions:

The flow rates of $H_2$ gas being as active species generative stock to be introduced into the space B was regulated at 300 SCCM; likewise, the flow rate of $SiF_4$ gas as precursor generative substance to be introduced was regulated to at 300 SCCM. As for the microwave power to be applied, a discharge energy of 300 W was used. The vacuum of the film forming chamber was regulated to be 0.002 Torr.

The results of the evaluation on the resulting deposited films were as shown in Table 2.

TABLE 2

| The distance of the opening of conduit 205 from the nozzle 213 (mm) | 0.05 | 1 | 20 | 70 | 100 | 200 | 300 |
|---|---|---|---|---|---|---|---|
| Characteristics of the deposited film | ○ | ⊙ | ⊙ | ⊙ | ⊙ | ⊙ | X |

⊙ Very much suitable for an electrophotographic photosensitive member
○ Usable for an electrophotographic photosensitive member
X Not usable for an electrophotographic photosensitive member

What we claim is:

1. A process for preparing an electrophotographic photosensitive member which comprises introducing an active species into a film forming space through a transportation space for the active species and a precursor into the film forming space through a transportation space for the precursor and chemically and mutually reacting the active species and the precursor in the film forming space in the absence of a plasma to form a light accepting layer on a substrate for electrophotography being placed in the film forming space.

2. The process according to claim 1, wherein the precursor is a material which can not or scarcely contribute to form the light accepting layer as long as it being in an energy state as there is, and the active species is a material which causes a chemical and mutual reaction with the precursor while giving an energy to the precursor thereby to make the precursor to be in a state capable of contributing to form the light accepting layer.

3. The process according to claim 1, wherein the precursor for a constituent photoconductive layer of the light accepting layer is a material which has been generated by subjecting a member selected from the group consisting of $Si_nX_{2n+2}$ (n=1, 2, 3—, X=F, Cl, Br, I), $(SiX_2)_n$ (n≧3, X=F, Cl, Br, I), $Si_nHX_{2n+1}$ (n=1, 2, 3,—, X=F, Cl, Br, I) and $Si_nH_2X_{2n}$ (n=1, 2, 3,—, X=F, Cl, Br, I) to the action of an energy, and the active species for a constituent photoconductive layer of the light accepting layer is a material which has been activated by subjecting a member selected from the group consisting of $H_2$, $SiH_4$, $SiH_3F$, $SiH_3Cl$, $SiH_3Br$, and $SiH_3I$ to the action of an energy.

4. The process according to claim 1, wherein the transportation space for the precursor is situated separately from and within the transporation space for the active species.

5. The process according to claim 4, wherein the transportation space for the precursor is opened in a downstream region of the transportation space for the active species.

6. The process according to claim 1, wherein the precursor is generated in the transportation space for the precursor.

7. The process according to claim 1, wherein the active species is generated in the transportation space for the active species.

8. The process according to claim 1, wherein the precursor is generated in the transportation space for the precursor and the active species is generated in the transportation space for the active species.

9. The process according to claim 1, wherein the precursor and the active species are mixed in advance before being introduced into the film forming space.

10. An apparatus for preparing an electrophotographic photosensitive member which comprises an active species generation chamber, an active species transportation passage being situated at the downstream-side of the active species generation chamber, a precursor generation chamber, a precursor transportation passage being situated separately from and within the active species transportation passage, a microwave power source being electrically connected to the active species generation chamber and the precursor generation chamber, and a film formation chamber having a substrate supporting means.

11. The apparatus according to claim 10, wherein the precursor generation chamber is opened in the downstream region of the active species transportation passage.

12. The apparatus according to claim 11, wherein the opening of the precursor generation chamber is in the form of a nozzle or an orifice.

13. The apparatus according to claim 10, wherein the opening of the active species transportation passage to the film forming chamber is in the form of a nozzle or an orifice.

14. The apparatus according to claim 11, wherein the precursor transportation passage is opened having a distance of 0.1 to 200 mm from the open portion of the active species transportation passage to the film forming chamber.

15. The apparatus according to claim 10, wherein the film forming chamber is provided with a means for heating the substrate.

16. An apparatus for preparing an electrophotographic photosensitive member which comprises a double conduit having an outer passage for an active species and an inner passage for a precursor, microwave power source being electrically connected to the circumference of the double conduit and a film forming chamber having a substrate supporting means.

17. The apparatus according to claim 16, wherein the double conduit is opened within the film forming chamber.

18. The apparatus according to claim 16, the open portion of the double conduit is in the form of a nozzle or an orifice.

* * * * *

UNITED STATES PATENT AND TRADEMARK OFFICE

CERTIFICATE OF CORRECTION

PATENT NO. : 4,702,934

DATED : October 27, 1987

INVENTOR(S) : SHUNICHI ISHIHARA, ET AL.

It is certified that error appears in the above-identified patent and that said Letters Patent is hereby corrected as shown below:

AT [73] IN THE ASSIGNEE

"Canon kabushiki Kaisha," should read --Canon Kabushiki Kaisha,--.

AT [30] IN THE FOREIGN APPLICATION PRIORITY DATA

"Mar. 28, 1985 [JP] Japan ..... 60-064248" should read --Mar. 28, 1985 [JP] Japan ..... 60-064246--.

COLUMN 1

Line 17, "indiced" should read --induced--.
Line 19, delete "technique".
Line 42, "reproductibility" should read --reproducibility--.

COLUMN 6

Line 6, delete "that".
Line 31, "span" should read --span,--.

COLUMN 7

Line 33, "3-, X-F," should read --3---, X=F,--.
Line 34, "3-," should read --3---,--.
Line 35, "3-," should read --3---,--.

COLUMN 8

Line 3, "DRAWING" should read --DRAWINGS--.
Line 5, "cross sectional" should read --cross-sectional--.
Line 58, "view points" should read --viewpoints--.

UNITED STATES PATENT AND TRADEMARK OFFICE

CERTIFICATE OF CORRECTION

PATENT NO. : 4,702,934

DATED : October 27, 1987

INVENTOR(S) : SHUNICHI ISHIHARA, ET AL.

It is certified that error appears in the above-identified patent and that said Letters Patent is hereby corrected as shown below:

COLUMN 9

Line 3, "In case" should read --In the case--.
Line 6, "successively formed." should read --successively be formed.--.
Line 14, "Firstly" should read --Firstly,--.
Line 38, "made" should read --made to be--.
Line 40, "like nitrogen" should read --like, nitrogen--.
Line 50, "$CH_4$ $C_2H_4$," should read --$CH_4$, $C_2H_4$,--.
Line 54, delete "they are".

COLUMN 10

Line 47, "in usual" should read --in the usual--.
Line 60, "surface layer 4" should read --surface layer 104--.
Line 66, "a relevant" should read --an appropriate--.

COLUMN 11

Line 9, "104." should read --101.--.
Line 13, "to" (second occurrence) should read --with--.

COLUMN 12

Line 1, "of drum" should read --of a drum--.
Line 21, "213'-provided" should read --213'---provided--.

UNITED STATES PATENT AND TRADEMARK OFFICE

CERTIFICATE OF CORRECTION

PATENT NO. : 4,702,934

DATED : October 27, 1987

INVENTOR(S) : SHUNICHI ISHIHARA, ET AL.

It is certified that error appears in the above-identified patent and that said Letters Patent is hereby corrected as shown below:

COLUMN 13

Line 15, "$Ch_4$ was" should read --$CH_4$ gas was--.
Line 18, "Further" should read --Further,--.
Line 50, "302." should read --312.--.
Line 50, "313'" should read --302'--.

COLUMN 14

Line 3, "of drum" should read --of a drum--.
Line 22, "of drum" should read --of a drum--.
Line 52, "3 μm, thick" should read --3 μm thick,--.

COLUMN 15

Line 20, delete "being".
Line 24, delete "to".
Line 55, "being in an energy state as there is," should read --is in an unexcited energy state--.
Line 65, "3-," should read --3---,--.
Line 67, "3,-," (both occurrences) should read --3---,--.

UNITED STATES PATENT AND TRADEMARK OFFICE

CERTIFICATE OF CORRECTION

PATENT NO. : 4,702,934

DATED : October 27, 1987

INVENTOR(S) : SHUNICHI ISHIHARA, ET AL.

It is certified that error appears in the above-identified patent and that said Letters Patent is hereby corrected as shown below:

COLUMN 18

Line 3, "16, the" should read --16, wherein the--.

Column 13

Line 43, "300" should read --311--.

Line 44, "315" should read --313--.

"wall" should read --walls--.

Line 45, delete "300", and change "has" to --have--.

Signed and Sealed this

Ninth Day of August, 1988

*Attest:*

*Attesting Officer*

DONALD J. QUIGG

*Commissioner of Patents and Trademarks*